United States Patent [19]

Gibson

[11] 4,170,264

[45] Oct. 9, 1979

[54] PUMP AND ROLL, VEHICLE WITH AN ELEVATABLE WATER TOWER

[75] Inventor: John C. Gibson, Lawrence, Mass.

[73] Assignee: Gibson Motor and Machine Service, Inc., Lawrence, Mass.

[21] Appl. No.: 819,291

[22] Filed: Jul. 27, 1977

[51] Int. Cl.[2] ..... A62C 27/08

[52] U.S. Cl. ..... 169/24; 239/165; 280/6 H

[58] Field of Search ..... 169/24; 239/165; 280/6 H; 267/31

[56] References Cited

U.S. PATENT DOCUMENTS

| | | | |
|---|---|---|---|
| 3,285,621 | 11/1966 | Turner, Jr. | 267/31 X |
| 3,770,062 | 11/1973 | Riggs | 169/24 |
| 4,037,664 | 7/1977 | Gibson | 169/24 |

*Primary Examiner*—Robert W. Saifer
*Attorney, Agent, or Firm*—Pearson & Pearson

[57] ABSTRACT

A vehicle for traveling alongside a burning airplane, on an airport runway, while pumping fire extinguishing fluid on the burning engines, wings or fuselage, is an elongated tank trailer with multiple rear wheel axles and a forward end supported on, and moved by a motorized tractor.

The trailer includes a 5000 gallon water tank, foam tanks, a built-in motor and pump, foam spreader bars and an elevatable water tower.

The trailer can pump from the nozzle of the elevated tower while advancing at the speed of the plane and includes mobile outrigger means to prevent overturning.

2 Claims, 2 Drawing Figures

PUMP AND ROLL, VEHICLE WITH AN ELEVATABLE WATER TOWER

BACKGROUND OF THE INVENTION

A tractor pulled, elongated, tank trailer with foam tanks, water tank, motorized pump, central platform, central valves and conduits, foam spreader bars and a turret type nozzle is taught in my U.S. Pat. No. Des. 239,616 of Apr. 20, 1976 and my U.S. Pat. No. 4,037,664 of July 26, 1977 I call such a trailer a "pump and roll" mobile unit because it can spread foam on an airport runway, or pump water, or foam, on a moving burning plane while traveling alongside at high speed.

The conventional fire engine pumper truck does not have this capability whether having only an ordinary turret nozzle, or having an elevatable water tower or "snorkel" because the pump of such pumpers is driven by the truck engine and it can only pump when the vehicle is stationary. During movement of the vehicle, the pump must be disconnected so that the truck engine can transmit its power to the truck wheels.

As far as I am aware there has been no pump and roll vehicle which not only carries its own fire extinguishing liquid and foam supply, carries its own engine and pump, carries its own foam spreader bars but also carries its own elevatable water tower capable of discharging liquid or foam from a nozzle while elevated to vertical position and while moving alongside a plane on a runway.

SUMMARY OF THIS INVENTION

In this invention a tractor pulled, tank trailer with water tank, foam tank, foam spreader bars, motorized pump, control valves and conduits and control platform, is a self sufficient unit capable of pumping fire estinguishing water or foam from the spreader bars while advancing at relatively high speed along an airport runway. Unlike pumper fire trucks it can pump while rolling and does not need to be stationary so that the truck engine can power the pump.

The tank trailer is equipped with an elevatable water tower having its base rotatable on the control platform and its tower, or boom normally extending forwardly and horizontally along the top of the elongated 5000 gallon water tank.

The control valves and conduits are so arranged that the tower can be lifted to vertical position on its base to enable the nozzle to discharge fire extinguishing liquid, or foam, from a high level onto the engine, wings or fuselage of a burning airplane traveling at high speed along an airport runway.

Air suspension means is mounted on the three rear axles for the six rear wheels of the trailer, with each side controlled by air valves from the central platform so that pressure may be increased to level the trailer on the side being tilted by reaction from the jet pressure of the nozzle.

DESCRIPTION OF A PREFERRED EMBODIMENT

Figure 1:
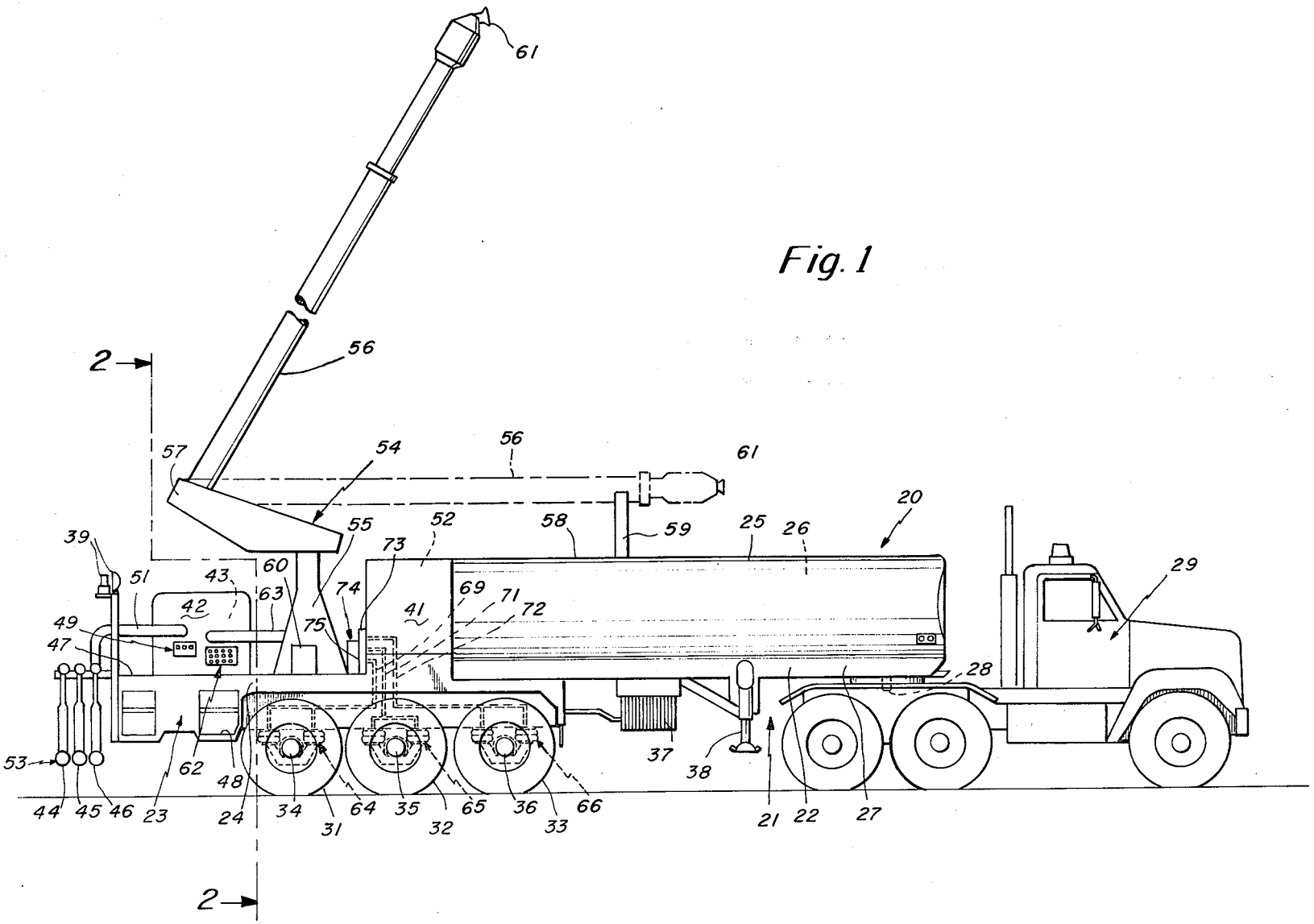
FIG. 1 is a schematic side elevation of a pump and roll trailer of the invention, showing the tower in retracted position in full lines and in elevated vertical position in dotted lines.

The "pump and roll", elevatable water tower vehicle 20 of the invention is an elongated, wheeled tank trailer 21, having an elongated main frame 22, a sub frame 23 at the rear 24, an elongated large volume tank 25 capable of holding about five thousand gallons of water 26 and a forward portion 27 with a conventional pintle 28 for removable attachment to a motorized tractor 29.

The multi-wheeled trailer preferably includes six rear wheels such as 31, 32 and 33, rotatable on three rear axles 34, 35 and 36, a booster hose 37, a retractable front support 38, and suitable tail lights 39. It also includes at least one, and preferably two, foam tanks, 41, a one thousand gallon per minute pump 42, driven by a built-in motor, such as a gasoline engine, 43, and a plurality of foam spreader bars 44, 45 and 46. The foam spreader bars are attachable end-to-end and connectable to the pump 42 and foam tanks 41 to spread a broad area of an airport runway with foam as the trailer is drawn at relatively high speed by the tractor 29.

The rearward control platform 47, includes steps 48 and permits an operator, not shown, to actuate first control valve means 49 of a known type, by way of conduit 51 to selectively pump foam 52 at high pressure from the orifices 53 of the extended foam spreader bars or to pump water 26 at high pressure therefrom.

Trailer 21 also includes an elevatable water tower 54, having a base 55 mounted on platform 47, and an elongated telescopable boom 56 rotatable on a vertical axis on the base 55 and pivoted at 57 to move from normal horizontal position, shown in dotted lines, extending along the top 58 of water tank 25 to an upstanding substantially vertical, elevated position, shown in full lines. The boom 56 is supported in bracket 59 on tank 25 and includes a movable nozzle 61 at the terminal tip which is adjustable and rotatable to direct the fire extinguishing liquid, or foam, stream emitted therefrom in any direction.

The water tower 54 may be of any well known, commercially available type such as the "Telesquirt" 35 manufactured by Snorkel Fire Equipment Company of St. Joseph, Mo., which tower weighs about three thousand pounds and is actuated by a hydraulic pump and tank power means indicated at 60.

Second control valve means 62 is provided, coordinated with the first central valve means 49 which may consist of the push button panel sold with the above specified "Telesquirt 35", and which, by way of conduits such as 63, enables the operator to selectively discharge either water 26" or foam 52 from the nozzle 61 of tower 54 while the trailer 21 is being advanced at high speed with the tower elevated, alongside a burning airplane moving along an airport runway.

Thus, instead of directing fire extinguishing fluid upwardly against the undercarriage of a burning, moving, plane the elevated tower trailer 21 can direct such fluid from the level of, or from above the level of, the burning engines, wings or fuselage of a large plane.

When a motorized fire truck pumper is equipped with an elevatable, telescopable water tower of the type shown herein, it is usually necessary to provide mechanical, extendable outriggers to prevent the reaction of the jet from the elevated nozzle on the tower from tending to topple the truck especially if the ground is not level.

Mechanical outriggers would be impractical for compensating for the tilt, or topple, effect of the pressurized jet from the elevated nozzle 61 of the rapidly moving trailer 21.

Therefore, in this invention, a third, or extra, axle 36, and pair of rear wheels such as 33, are provided, and air bag suspension means such as 64, 65 and 66 is mounted on each of the three axles. Air bag suspension means 64, 65 and 66 are preferably of the "Quick Lift" type manufactured by "Turner/Quick-Lift" Corporation of Canton, Ohio and consisting of separate individual air bags, such as 67 and 68 on each opposite side of each axle, between the axle and frame 22, each air bag having an air pressure conduit such as 69, 71 and 72 to a control valve panel 73 and to a source of air pressure 74 such as an air pump, motor and tank 75.

Figure 2:
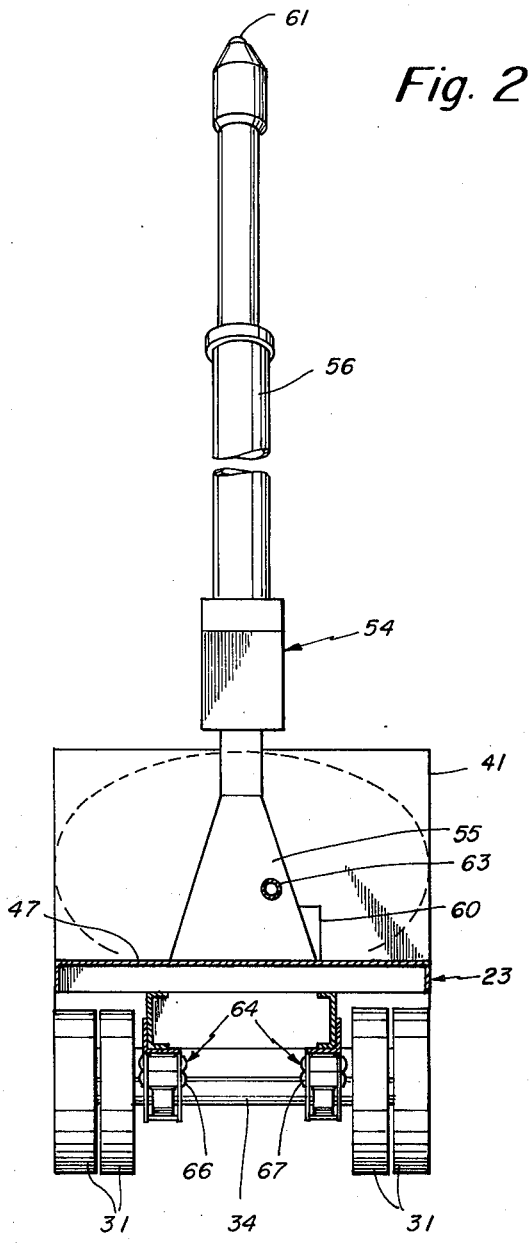
FIG. 2 is a schematic end elevation in section on line 2—2 of FIG. 1 showing the air suspension means forming a mobile outrigger to compensate for tower nozzle pressure while the trailer is moving at high speed.

As best shown in FIG. 2 when the trailer 21 is on sloping ground, or when the trailer is being advanced at high speed with the tower boom 56 elevated, and the nozzle 61 discharging pressurized fluid sidewise on one side, the operator is able to actuate the air pressure system 74 and 75 to increase air pressure in the three air bags on the opposite side of the trailer to restore level and compensate for the tendency of the nozzle jet to tilt, or topple the moving trailer. I call this mobile outrigger means as compared to the stationary mechanical outrigger used for stationary crane, or water tower vehicles.

The air suspension means 64, 65 and 66 is fully disclosed and described in U.S. Pat. Nos. 3,285,621 of Nov. 15, 1966 and 3,617,072 of Nov. 2, 1971, both to Stephen Turner, Jr., such disclosures being incorporated herewith so as not to have to be repeated redundantly herein.

I claim:

1. A pump and roll, elevatable water tower, vehicle for traveling alongside a moving, burning airplane while pumping liquid, or foam, thereon, said vehicle comprising:

an elongated, wheeled trailer, adapted to be drawn by a motorized tractor, said trailer having an elongated large volume tank, containing fire extinguishing liquid; at least one tank containing fire extinguishing foam, an internal combustion type motor driven pump, a plurality of foam spreader bars and first control valve and conduit means for connecting said tanks and pump to said spreader bars for selectively pumping either water or foam therefrom and an elevatable water tower, having a base affixed on a central platform proximate the rear of said trailer, a nozzle and an elongated boom pivoted to said base and normally retracted to extend forwardly along, and in substantial parallelism with the top of said elongated water tank, power means for elevating said elongated boom to upstanding position, while said trailer is being moved by said tractor, second control valve and conduit means, connecting said water tower to said first control valve and conduit means, tanks and motor driven pump for selectively pumping fire extinguishing fluid from said nozzle of said boom, while it is erected and said trailer is moving;

the rear wheels of said elongated wheeled trailer including air suspension means on each opposite side of each wheel axle;

air pressure control means connecting the air suspension means on each opposite side of said axles to a source of air pressure and to a control valve on a control valve panel on the control platform of said trailer; and the air pressure in the air suspension means on the side of said trailer, pushed downwardly out of level, by the reaction of fluid emitted from the nozzle of said elevated tower during movement of said trailer, being increasable by actuation of said control valve to compensate and restore level.

2. A pump and roll, elevatable water tower, vehicle for traveling alongside a moving, burning airplane while pumping liquid, or foam, thereon, said vehicle comprising:

an elongated, wheeled trailer, adapted to be drawn by a motorized tractor, said trailer having an elongated large volume tank, containing fire extinguishing liquid; at least one tank containing fire extinguishing foam, an internal combustion type motor driven pump, a plurality of foam spreader bars and first control valve and conduit means for connecting said tanks and pump to said spreader bars for selectively pumping either water or foam therefrom and an elevatable water tower, having a base affixed on a central platform proximate the rear of said trailer, a nozzle and an elongated boom pivoted to said base and normally retracted to extend forwardly along, and in substantial parallelism with the top of said elongated water tank, power means for elevating said elongated boom to upstanding position, while said trailer is being moved by said tractor, second control valve and conduit means, connecting said water tower to said first control valve and conduit means, tanks and motor driven pump for selectively pumping fire extinguishing fluid from said nozzle of said boom, while it is erected and said trailer is moving;

said trailer being free of mechanical outriggers, the rear wheels thereof having air suspension bags on the axles, and there being a cluster of three such air suspension bag axles to compensate for the reactive forces of fluid being emitted from the nozzle of said water tower when elevated and when said trailer is moving at relatively high speed, and control means for selectively increasing or decreasing the air pressure in said air bags while said trailer is moving.

* * * * *